US010337822B2

(12) United States Patent
Hofman et al.

(10) Patent No.: US 10,337,822 B2
(45) Date of Patent: Jul. 2, 2019

(54) GUN SCRAPER TOOL

(71) Applicant: Revo Brand Group, LLC, Plymouth, MN (US)

(72) Inventors: James Hofman, Eden Prairie, MN (US); Ryan Jacobson, Minneapolis, MN (US)

(73) Assignee: Revo Brand Group, LLC, Plymouth, MN (US)

( * ) Notice: Subject to any disclaimer, the term of this patent is extended or adjusted under 35 U.S.C. 154(b) by 0 days.

(21) Appl. No.: 15/686,634

(22) Filed: Aug. 25, 2017

(65) Prior Publication Data

US 2018/0058796 A1 Mar. 1, 2018

Related U.S. Application Data

(60) Provisional application No. 62/379,886, filed on Aug. 26, 2016.

(51) Int. Cl.
*F41A 29/02* (2006.01)

(52) U.S. Cl.
CPC ..... *F41A 29/02* (2013.01)

(58) Field of Classification Search
CPC ..... F41A 35/00; F41A 29/02; F41A 29/00; F41C 27/00
USPC ..... 42/108, 95
See application file for complete search history.

(56) References Cited

U.S. PATENT DOCUMENTS

| | | | | |
|---|---|---|---|---|
| 7,637,049 | B1 * | 12/2009 | Samson | F41A 35/00 42/107 |
| 7,644,529 | B2 * | 1/2010 | Hopper | F41A 29/02 15/93.1 |
| D666,883 | S * | 9/2012 | Howard | F41A 35/00 D8/19 |
| 8,479,404 | B1 * | 7/2013 | Samson | F41A 35/00 33/506 |
| 9,127,899 | B2 * | 9/2015 | Shipman | F41C 27/00 |
| 9,279,634 | B2 * | 3/2016 | Shipman | F41A 29/02 |
| D761,631 | S * | 7/2016 | Jacobson | F41A 29/02 D8/105 |
| 2009/0151214 | A1 * | 6/2009 | Williams | F41A 29/02 42/95 |
| 2009/0178324 | A1 * | 7/2009 | Hopper | F41A 29/02 42/90 |
| 2009/0199345 | A1 * | 8/2009 | Morgan | B25F 1/04 7/118 |

(Continued)

*Primary Examiner* — Jonathan C Weber
(74) *Attorney, Agent, or Firm* — Grumbles Law, LLC; Brittany Nanzig; Stephen F. Wolf

(57) ABSTRACT

A gun scraper tool has elements that are adapted to maintain firearms. More specifically, a gun scraper tool can have several components and scraping surfaces that can be used to disassemble a firearm and/or to scrape carbon and residue off of the appropriate areas of the firearm by using scraping surfaces. The gun scraper tool can have a roughly triangular housing and a plurality of tool components and scraping surfaces that use the housing as the base. The tool components and scraping surfaces can include a spindle, an exterior scraping blade, a pivoting brush have a base and a set of bristles, a cotter pin puller, a bolt tail brush having bristles, and a bolt carrier scraper. The variety of tasks capable of being accomplished with the disclosed gun scraper tool can minimize the need for additional cleaners or tools.

12 Claims, 21 Drawing Sheets

(56) References Cited

U.S. PATENT DOCUMENTS

| | | | | |
|---|---|---|---|---|
| 2010/0186769 | A1* | 7/2010 | Jaquish | B08B 1/00 134/6 |
| 2011/0113669 | A1* | 5/2011 | Oselinsky | F41A 29/02 42/90 |
| 2011/0314719 | A1* | 12/2011 | Tripp | B25B 13/56 42/108 |
| 2012/0186127 | A1* | 7/2012 | Shipman | F41A 29/02 42/95 |
| 2013/0192118 | A1* | 8/2013 | Shipman | F41C 27/00 42/108 |
| 2013/0255722 | A1* | 10/2013 | Davis | F41A 29/02 134/8 |
| 2015/0308686 | A1* | 10/2015 | Hensley | F23Q 1/06 42/90 |
| 2015/0354914 | A1* | 12/2015 | Otter | F41A 29/00 134/8 |
| 2016/0305731 | A1* | 10/2016 | Casey | F41A 29/02 |

* cited by examiner

GUN SCRAPER TOOL

CROSS-REFERENCE TO RELATED APPLICATION

This application claims the benefit of U.S. Provisional Application No. 62/379,886 filed Aug. 26, 2016 and titled GUN SCRAPER TOOL.

FIELD OF THE INVENTION

This disclosure relates to multi-tools. More specifically, it relates to gun scraper tools that are adapted to maintain firearms.

BACKGROUND OF THE INVENTION

Firearms are negatively affected by moisture, rust, carbon, and gunpowder residue and need to be cleaned as a part of regular use so they do not rust and decay. To accomplish this, several types of gun cleaning kits and systems exist, with the majority of cleaning kits custom designed for a specific type of firearm, such as an AR-15. However, because firearms, such as the AR-15, often have a large number of surfaces and parts that require cleaning, existing cleaning kits and systems include several tools, each designed not only for a specific firearm, but for a specific firearm part. These pieces can be easily misplaced, and convenient storage and transport can be a challenge. Therefore, a gun cleaning tool is needed that can clean multiple firearm components and that is easy to keep on hand for quick and convenient use.

SUMMARY OF THE INVENTION

The present disclosure relates to a gun scraper tool having several components and surfaces that can be used to accomplish various gun-cleaning functions. The components and surfaces of the gun scraper tool can be used to disassemble the firearm and/or to scrape carbon and residue off of the appropriate areas of the firearm.

DETAILED DESCRIPTION

Figure 1:
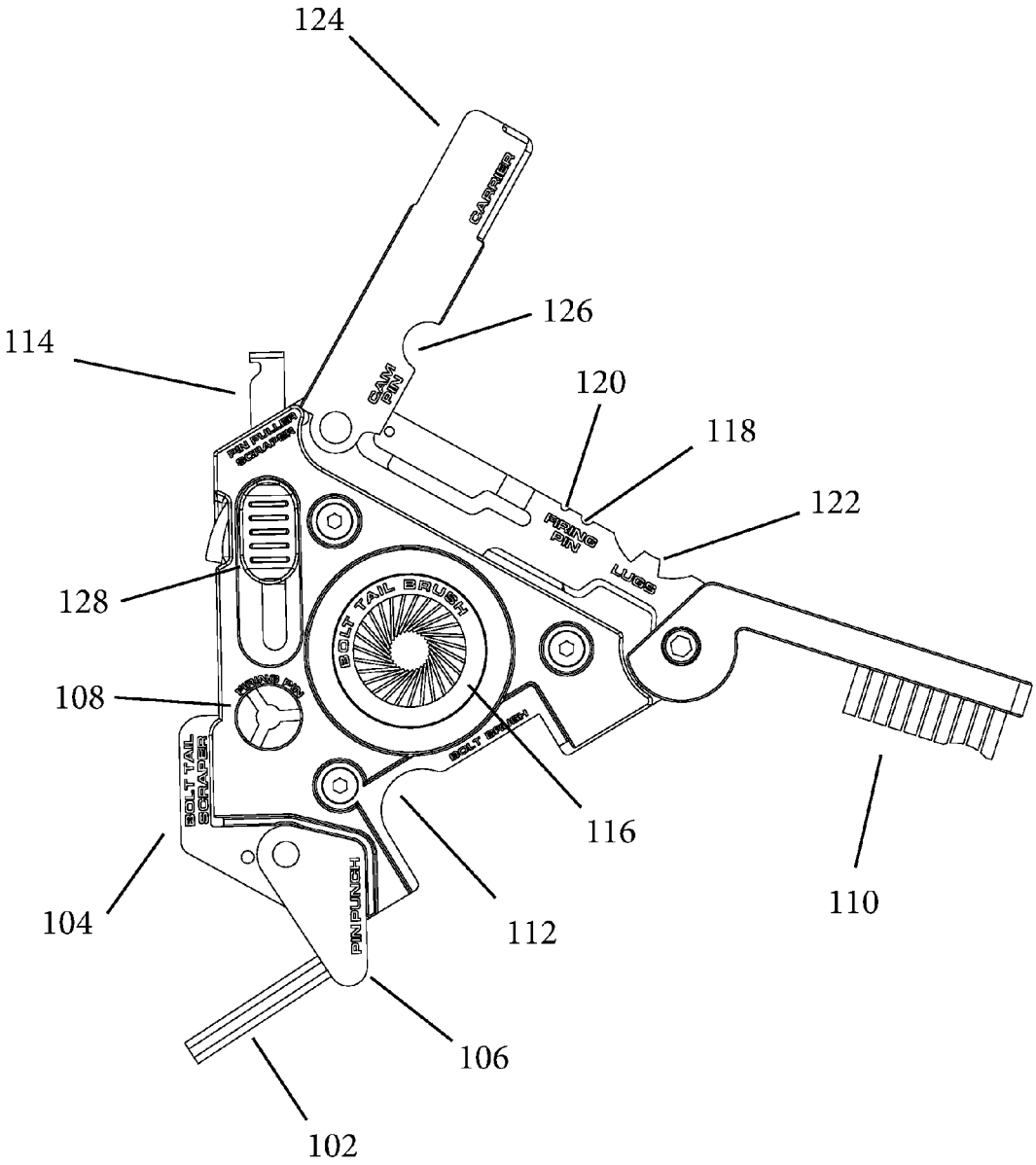
FIG. 1 is a top plan view of a gun scraper tool in an extended configuration according to one embodiment of the present disclosure.

The present disclosure relates to a gun scraper tool that is used to easily and efficiently remove carbon and residue from a firearm, such as an AR-15 or other firearm variants. Various embodiments of the gun scraper tool will be described in detail with reference to the drawings, wherein like reference numerals represent like parts and assemblies throughout the several views. Reference to various embodiments does not limit the scope of the gun scraper tool disclosed herein. Additionally, any examples set forth in this specification are not intended to be limiting and merely set forth some of the many possible embodiments for the gun scraper tool. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

Some embodiments of the gun scraper tool disclosed herein include features that are best suited to cleaning an AR-15 rifle. The various surfaces of the gun scraper tool allow shooters to scrape carbon and residue off of the firearm by using scraping surfaces and bronze phosphor and nylon brushes that are included on the device. The variety of tasks capable of being accomplished with the disclosed tool can minimize the need for additional cleaners or tools.

Generally, the gun scraper tool can have a low profile, a compact size, a roughly triangular shape, and the tool can incorporate surfaces and extensions that accomplish the various cleaning tasks required for a firearm. In one embodiment, the surfaces and extensions can correspond to tools used to clean and disassemble various components of an AR-15. These features can enable a user to disassemble and clean several of the firearm's parts. In one embodiment, the gun scraper tool can be sized so as to be easy and convenient for a user to hold in one hand. The gun scraper tool can be, in some embodiments, approximately fifteen millimeters thick.

As illustrated in FIG. 1, one embodiment of the disclosed disclosure can include any combination of a spindle 102, an exterior scraping blade 104, a spindle mount 106, a firing pin scraper 108, a pivoting brush 110, a cotter pin puller 114, a bolt tail brush 116, a large firing pin scraper 118, a small firing pin scraper 120, a bolt lug scraper 122, a bolt carrier scraper 124, and a bolt cam pin scraper 126. Additionally, the embodiment of the gun scraper tool illustrated in FIG. 1 can have a housing comprised of three main layers that can be sandwiched together and operate as a base for the majority of the above-listed components. The gun scraper tool can be configured to allow the components to attach to the surfaces of the housing.

FIGS. 1-33 illustrate various views of an example of the gun scraper tool according to the present disclosure, wherein FIGS. 1-10 illustrate various views of the gun scraper tool with all extendable tools in their extended configurations, FIGS. 11-20 illustrate various views of the gun scraper tool in the closed configuration, and FIGS. 21-33 illustrate the various components in use.

Figure 2:
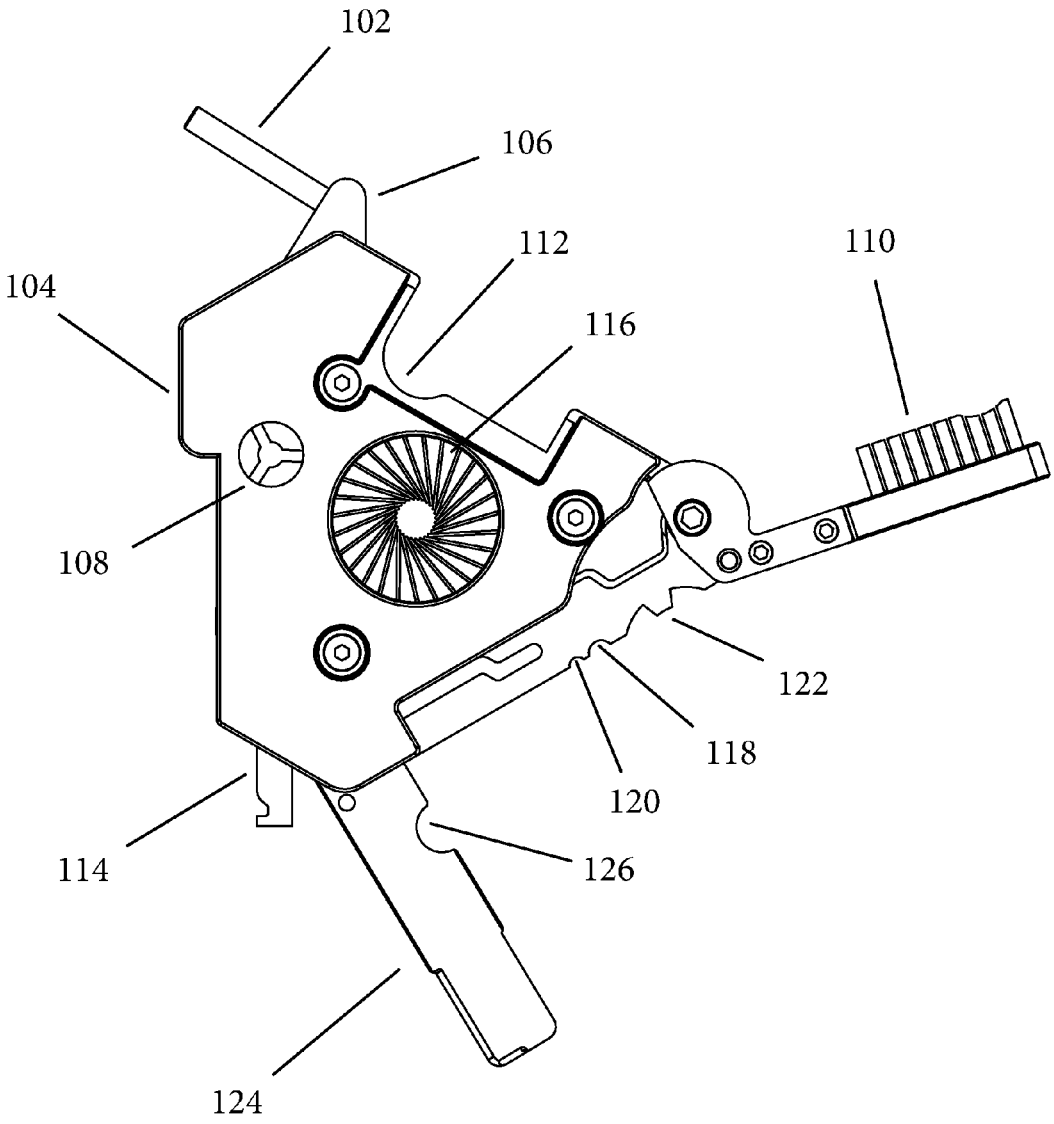
FIG. 2 is a bottom plan view of the gun scraper tool in an extended configuration.
Figure 3:
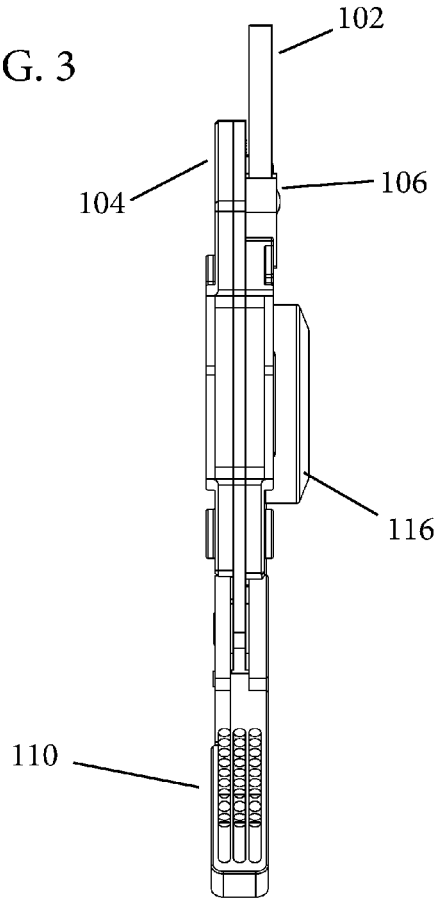
FIG. 3 is a side elevational view of the gun scraper tool in an extended configuration.
Figure 4:
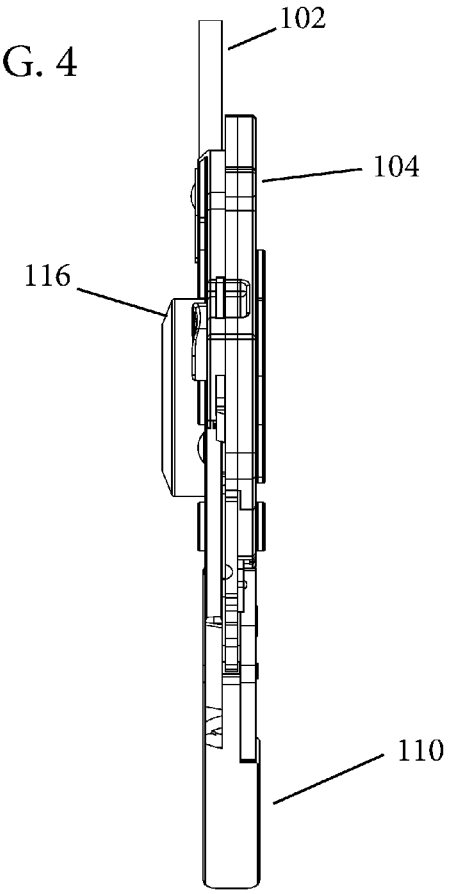
FIG. 4 is a side elevational view of the gun scraper tool in an extended configuration.
Figure 5:
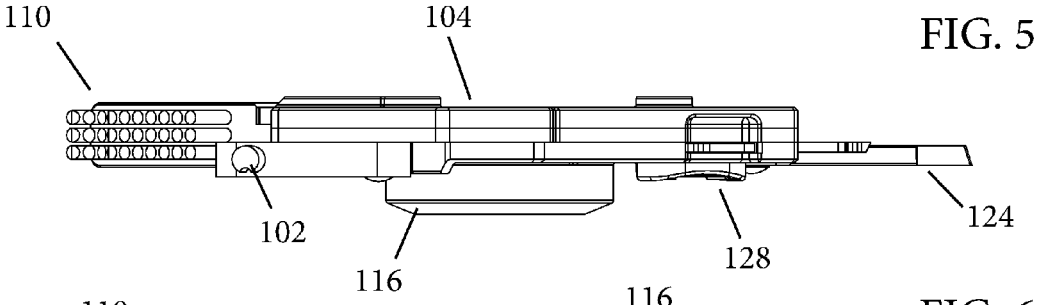
FIG. 5 is a side elevational view of the gun scraper tool in an extended configuration.
Figure 6:
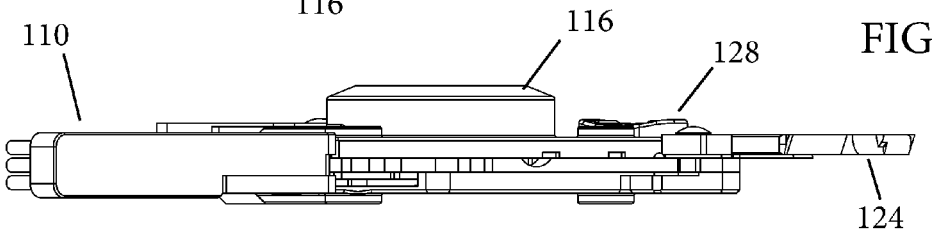
FIG. 6 is a side elevational view of the gun scraper tool in an extended configuration.
Figure 7:
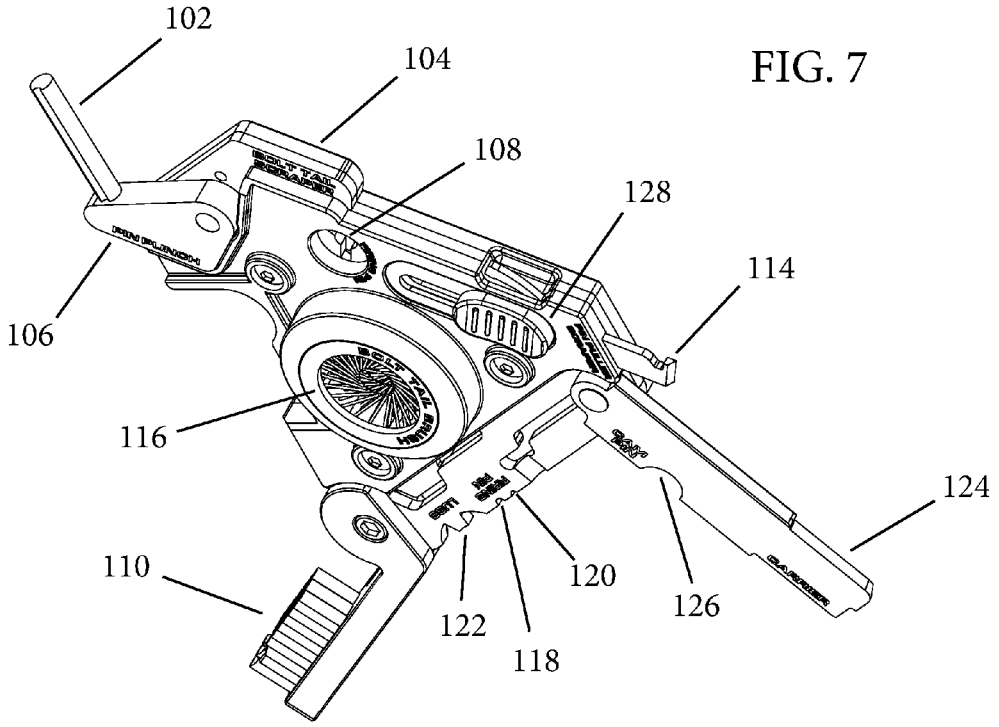
FIG. 7 is a perspective top view of the gun scraper tool in an extended configuration.
Figure 8:
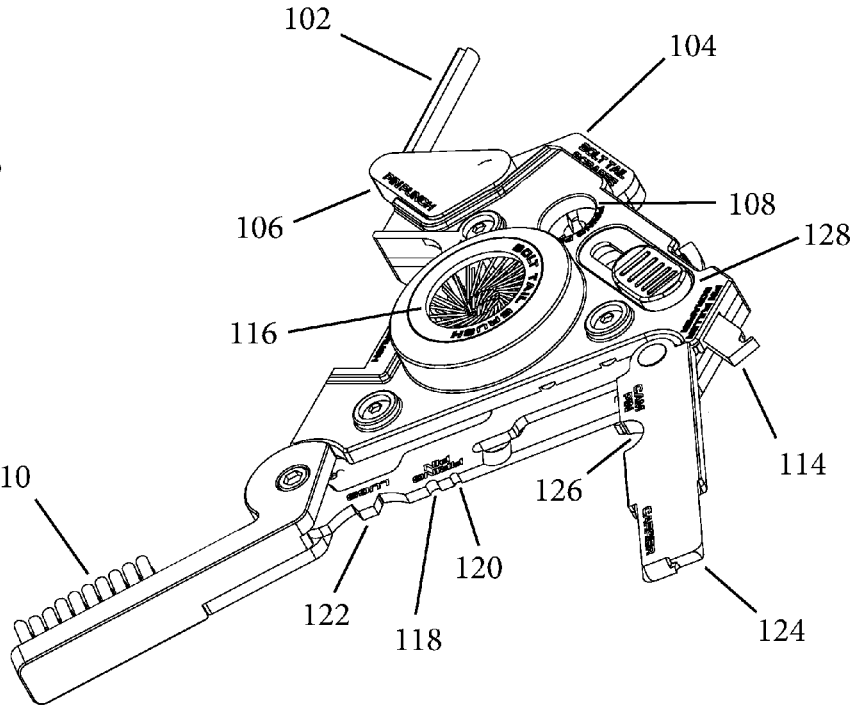
FIG. 8 is a perspective top view of the gun scraper tool in an extended configuration.
Figure 9:
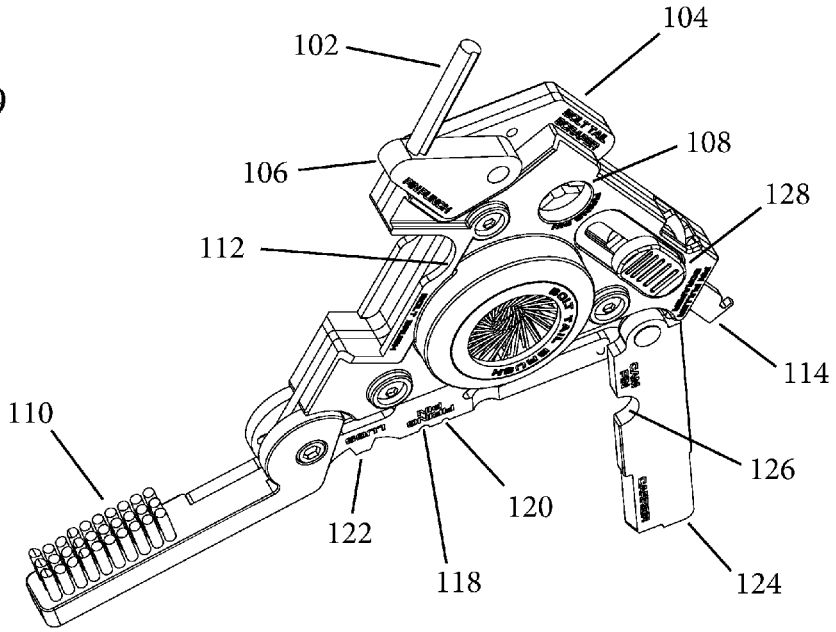
FIG. 9 is a perspective top view of the gun scraper tool in an extended configuration.
Figure 10:
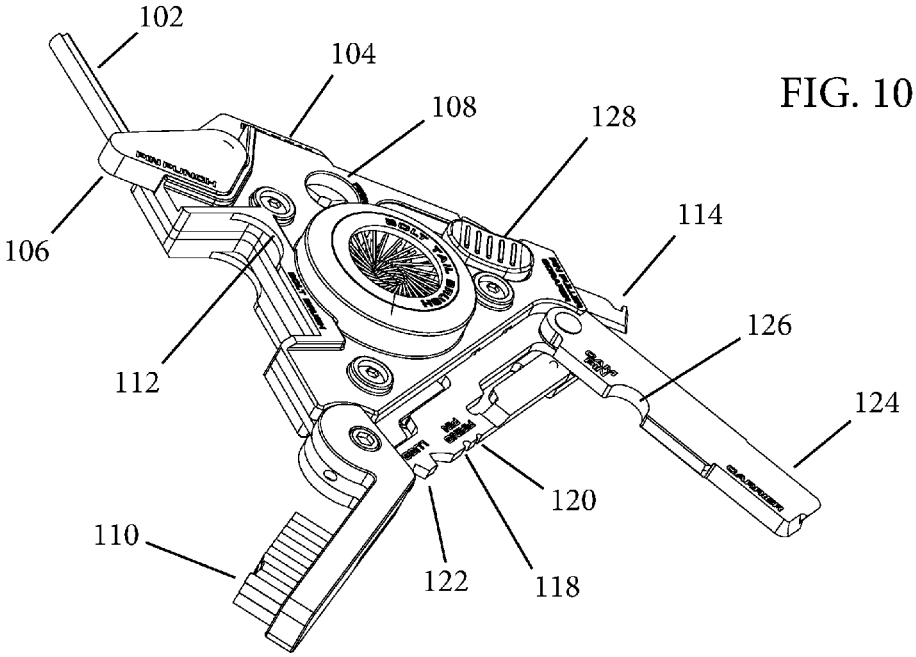
FIG. 10 is a perspective top view of the gun scraper tool in an extended configuration.

FIG. 1 is a top plan view of one embodiment of the gun scraper tool with all extendable tools in their extended configurations. FIG. 2 is a bottom plan view. FIG. 3 is a side elevational view. FIG. 4 is a side elevational view. FIG. 5 is a side elevational view. FIG. 6 is a side elevational view. FIG. 7 is a perspective top view. FIG. 8 is a perspective top view. FIG. 9 is a perspective top view. FIG. 10 is a perspective top view.

Figure 11:
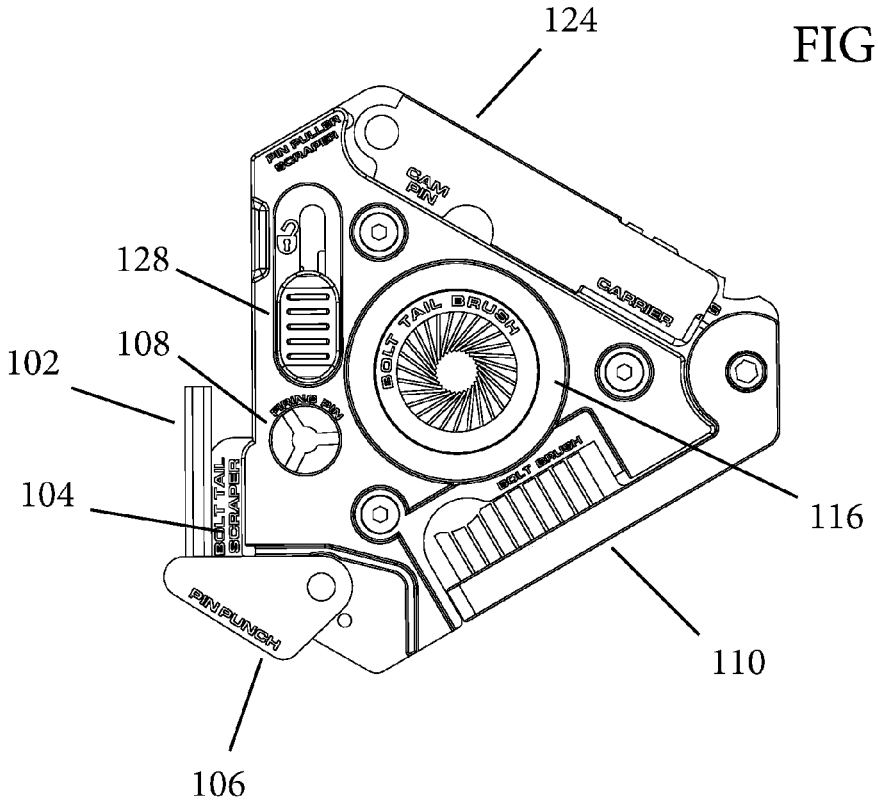
FIG. 11 is a top plan view of the gun scraper tool in a closed configuration.
Figure 12:
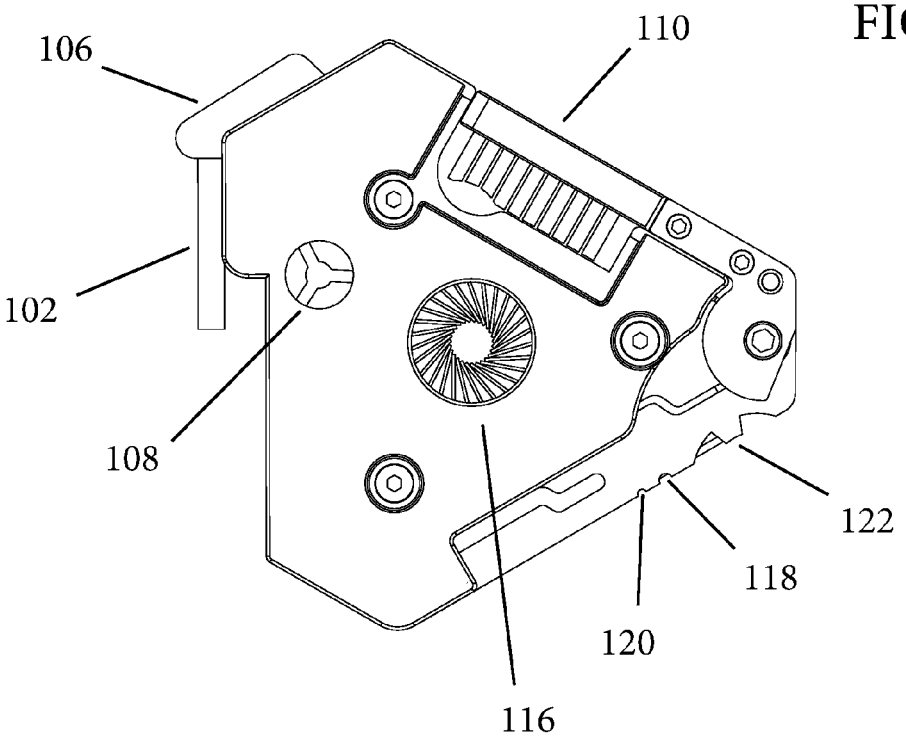
FIG. 12 is a bottom plan view of the gun scraper tool in a closed configuration.
Figure 13:
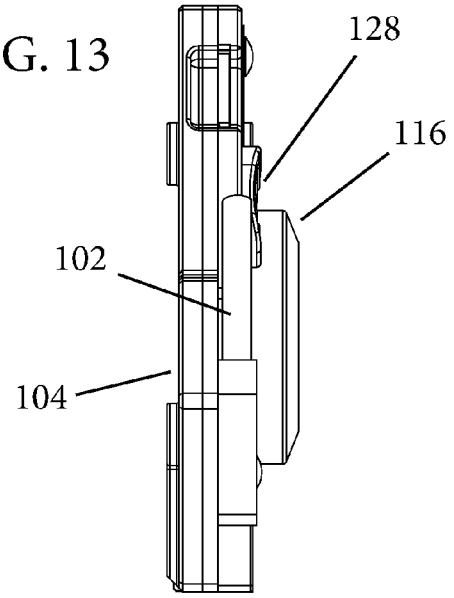
FIG. 13 is a side elevational view of the gun scraper tool in a closed configuration.
Figure 14:
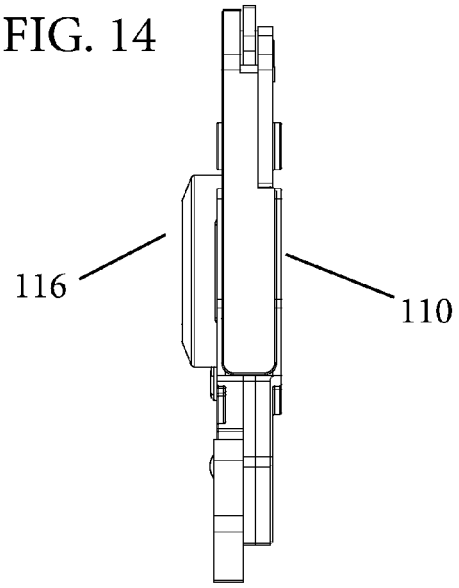
FIG. 14 is a side elevational view of the gun scraper tool in a closed configuration.
Figure 15:
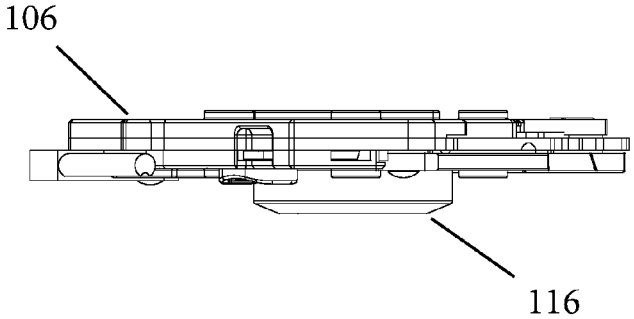
FIG. 15 is a side elevational view of the gun scraper tool in a closed configuration.
Figure 16:
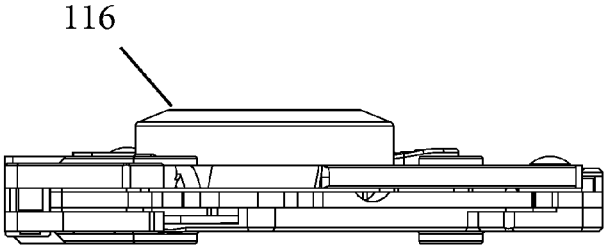
FIG. 16 is a side elevational view of the gun scraper tool in a closed configuration.
Figure 17:
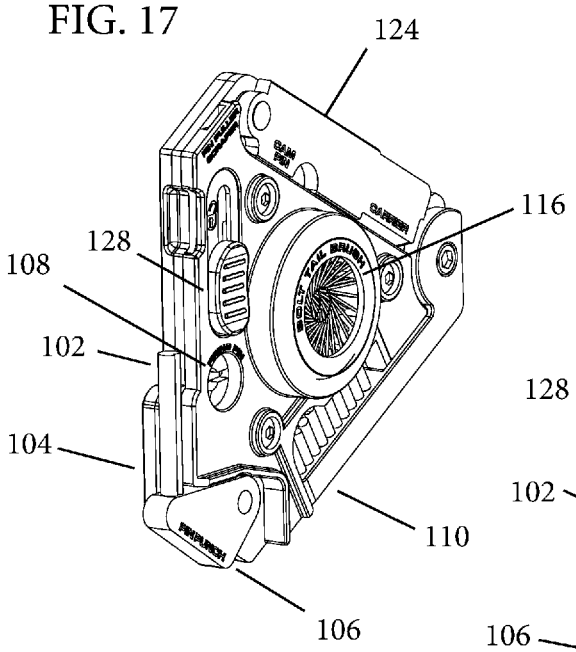
FIG. 17 is a perspective top view of the gun scraper tool in a closed configuration.
Figure 18:
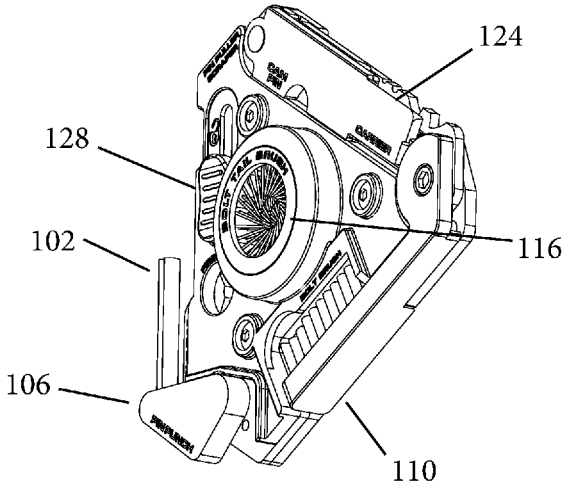
FIG. 18 is a perspective top view of the gun scraper tool in a closed configuration.
Figure 19:
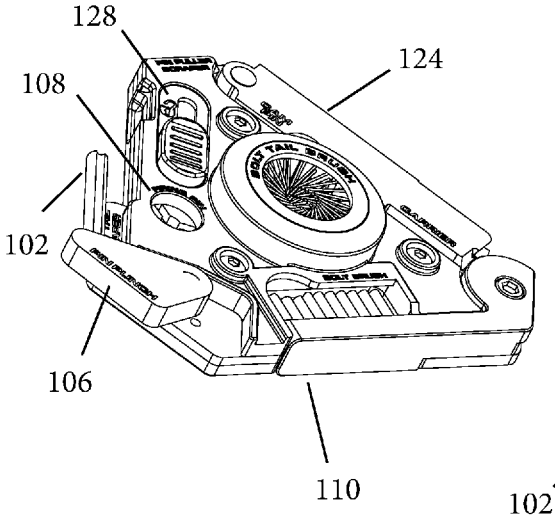
FIG. 19 is a perspective top view of the gun scraper tool in a closed configuration.
Figure 20:
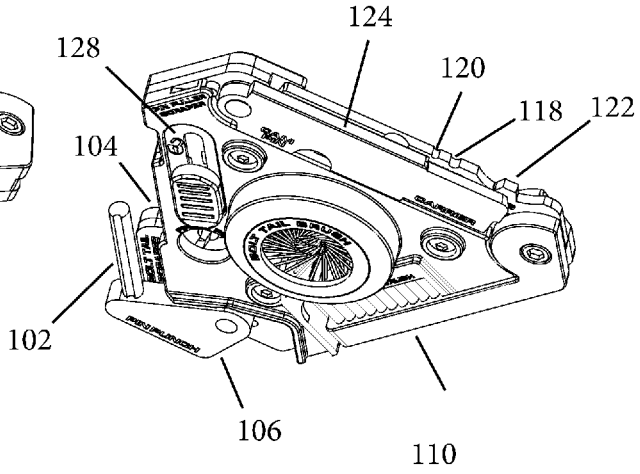
FIG. 20 is a perspective top view of the gun scraper tool in a closed configuration.

FIG. 11 is a top plan view of one embodiment of the gun scraper tool in the closed configuration. FIG. 12 is a bottom plan view. FIG. 13 is a side elevational view. FIG. 14 is a side elevational view. FIG. 15 is a side elevational view. FIG. 16 is a side elevational view. FIG. 17 is a perspective top view. FIG. 18 is a perspective top view. FIG. 19 is a perspective top view. FIG. 20 is a perspective top view.

The outer two layers of the gun scraper tool can be plastic and provide a protective housing for the tools and components and can also offer a comfortable grip for the user. The middle layer can be a main body made of metal, such as, but not limited to, stainless steel, that includes the scraping surfaces and that can be attached to the scraper extensions that rotate or slide away from the three main layers. All three of the layers can be roughly triangular and can align on top of one another to create a unified object.

Figure 21:
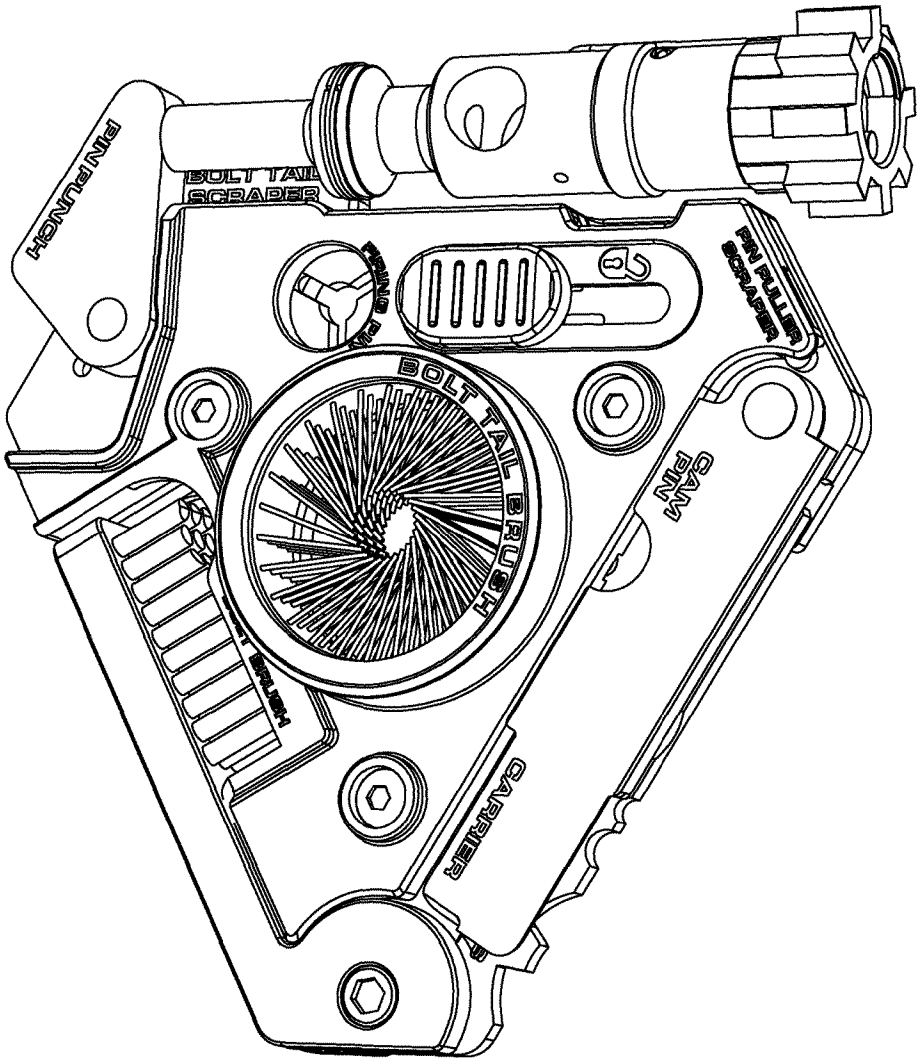
FIG. 21 illustrates one embodiment of the gun scraper tool in use.

As described above, some embodiments of the gun scraper tool can include a spindle 102, which is useful for scraping clean an AR-15 rifle bolt tail. Additionally, some embodiments of the gun scraper tool can include an exterior scraping blade 104 that runs parallel to the spindle 102, as illustrated in FIGS. 11 and 12, and may also be useful for scraping an AR-15 rifle bolt tail clean. For example, the spindle 102 can scrape the inside of the bolt tail by pivoting against the scraping blade 104, as illustrated in FIG. 21. More specifically, the spindle 102 can be sized to the interior diameter of the bolt tail and the exterior scraping blade 104 can conform to the diameter and curve of the bolt tail so that when a user rotates the bolt tail, the spindle 102 and exterior scraping blade 104 simultaneously scrape carbon and residue from the interior and exterior surfaces of the bolt tail.

As illustrated in FIGS. 1-4, 7-12, and 17-20, the spindle 102 can be roughly cylindrical in shape, can have a notch running lengthwise, and can be positioned against, or in close proximity to, the exterior scraping blade 104. The exterior scraping blade 104 can have a roughly rectangular scraping blade and can protrude from the housing. Alternatively, the housing can be configured such that the exterior scraping blade 104 is an extension of the middle, metal layer. Both the spindle 102 and the exterior scraping blade 104 can be made of metal, such as, but not limited to, steel.

Figure 22:
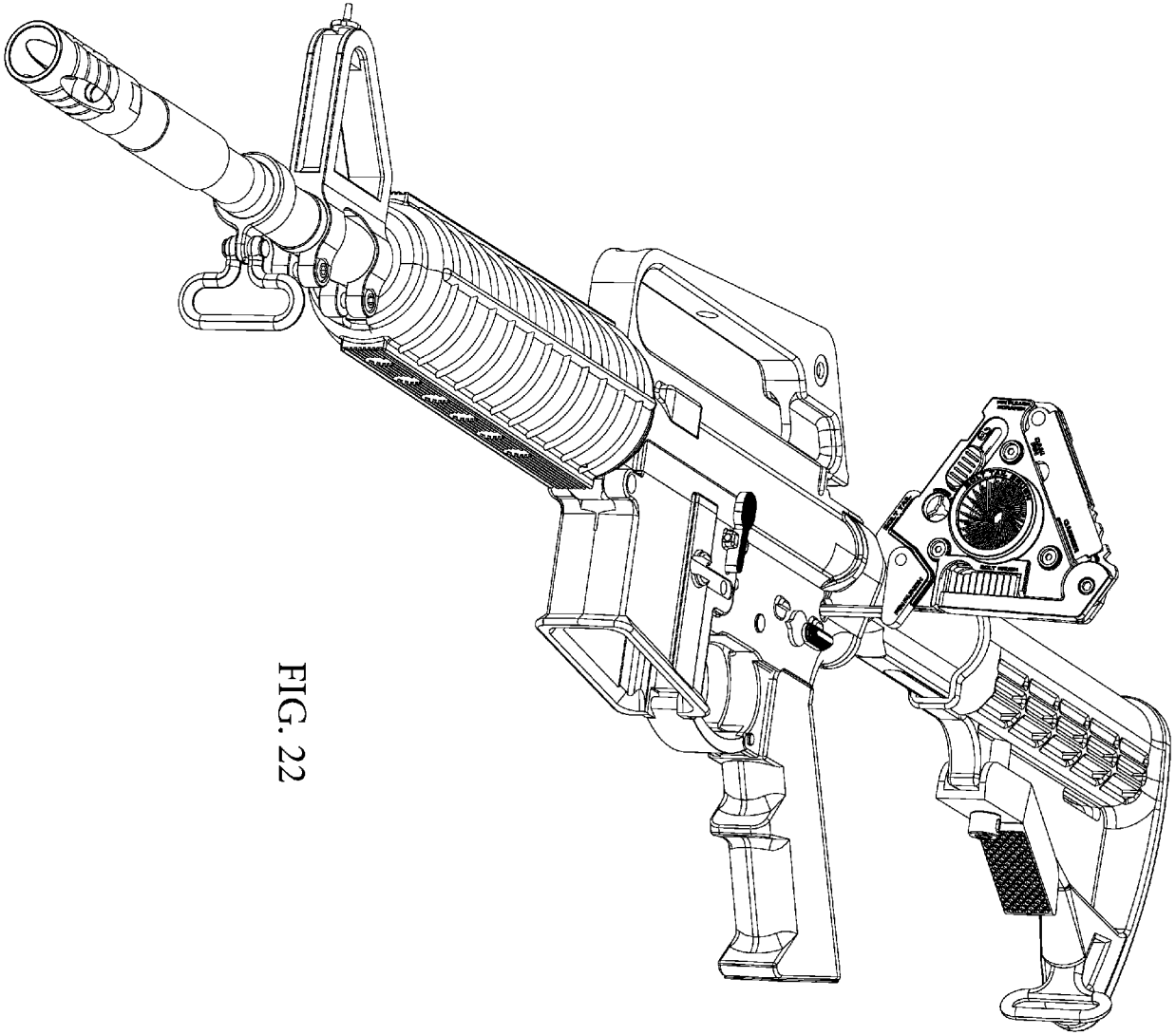
FIG. 22 illustrates one embodiment of the gun scraper tool in use.

In some embodiments, the spindle 102 can be attached to a spindle mount 106 that rotates approximately 90 degrees to enable the spindle 102 to project outward away from the housing, as illustrated in FIGS. 1-2 and 7-10. When the spindle 102 rotates out, it can be used as a pin punch for disassembling the various components of the AR-15 rifle, as illustrated in FIG. 22.

As illustrated in FIGS. 1, 7-11, and 17-20, the spindle mount 106 can be pivotally attached to the housing on a first end and fixedly attached to the spindle 102 on a second end. The spindle mount 106 can be roughly triangular in shape and the housing can include a cutout that enables the spindle mount 106 to rest at least one of its sides against the housing in its two primary configurations, wherein the first configuration, illustrated in FIG. 11, positions the spindle 102 parallel to the exterior scraping blade 104 and the second configuration, illustrated in FIG. 1, rotates the spindle 102 approximately 90 degrees outward so it can be used as a pin punch.

Figure 23:
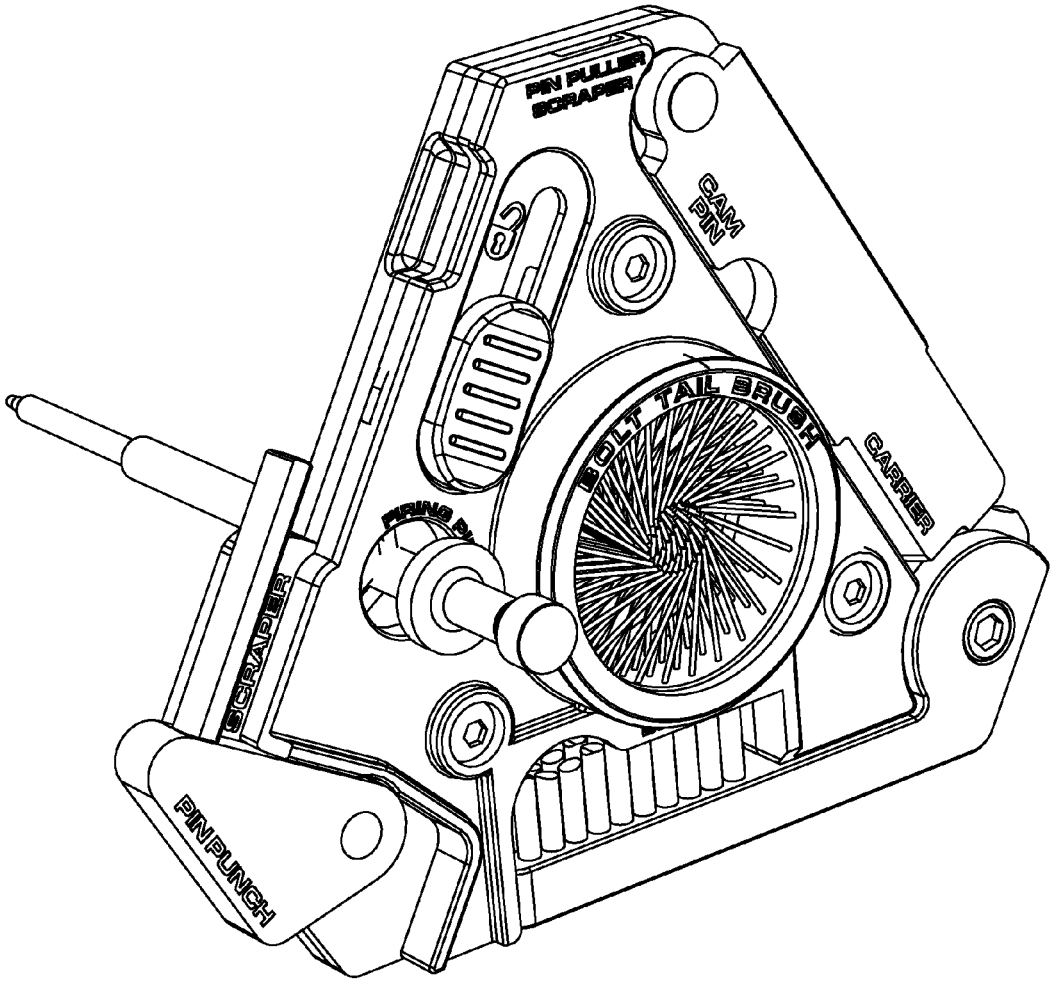
FIG. 23 illustrates one embodiment of the gun scraper tool in use.

As described above, some embodiments of the gun scraper tool include a firing pin scraper 108, which is useful for removing carbon and residue from the face and corners of the firing pin, as illustrated in FIG. 23. As illustrated in FIGS. 1-2 and 11-12, the firing pin scraper 108 can be comprised of a circular metal component having a small, circular center cutout as well as channel cutouts that project outward from the circular center. The firing pin scraper 108 can be rooted in, and surrounded by, the housing. More specifically, a circular cutout in the housing can correspond to the shape and size of the metal firing pin scraper 108. In some embodiments, there are three channel cutouts that project outward from the circular center cutout and can be equidistant from each other.

Figure 24:
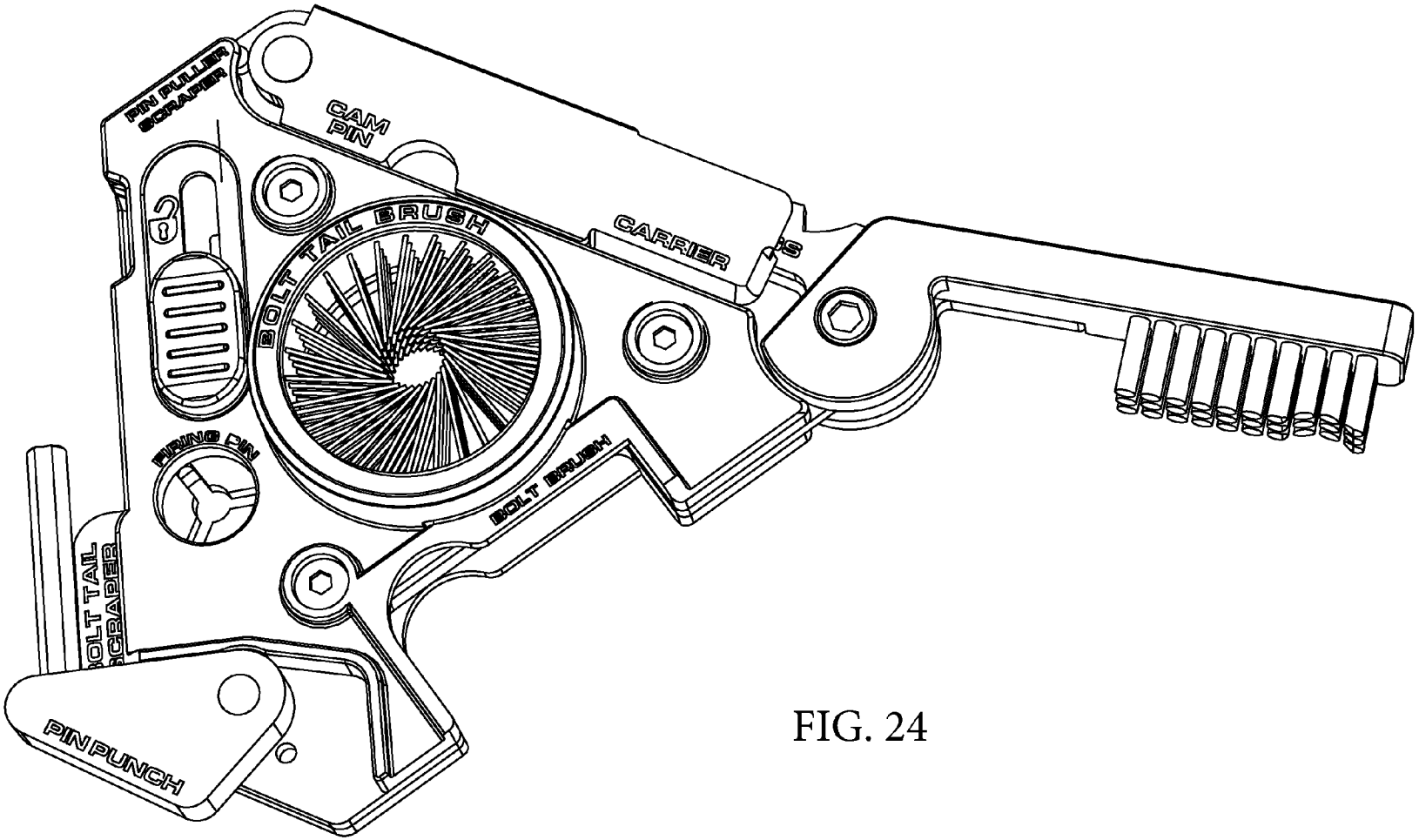
FIG. 24 illustrates one embodiment of the gun scraper tool in use.
Figure 25:
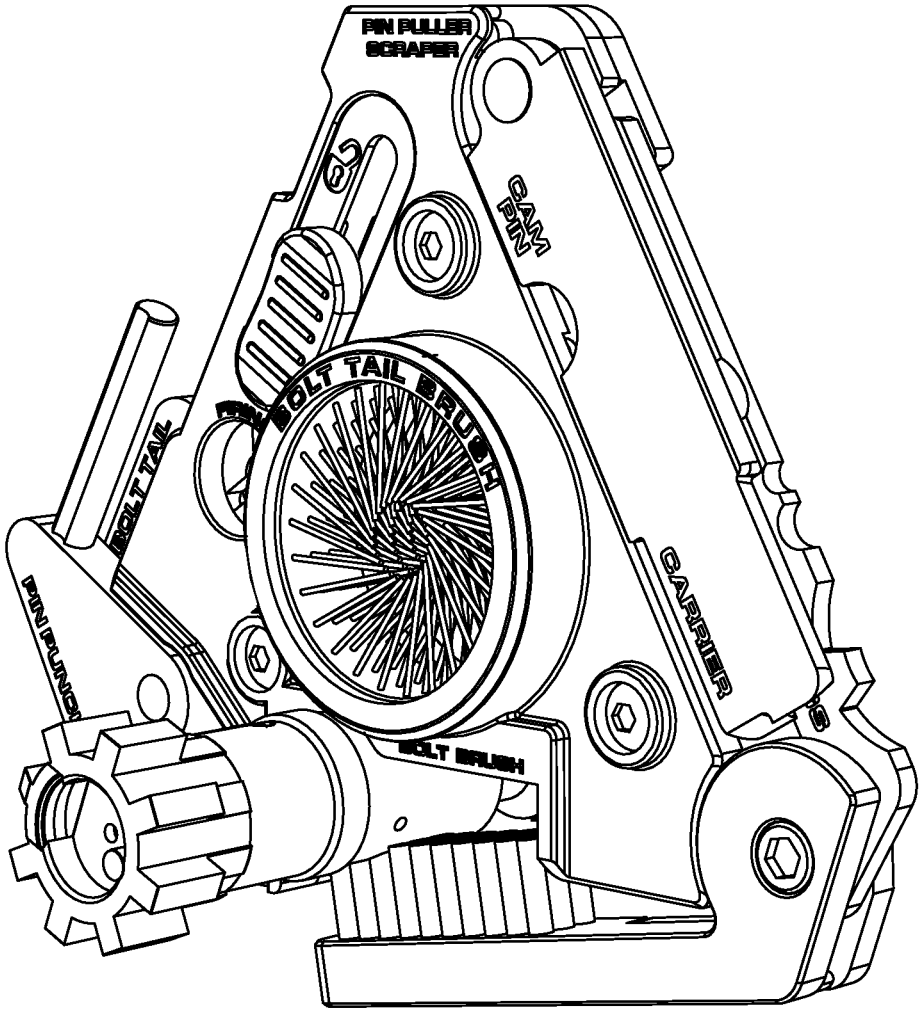
FIG. 25 illustrates one embodiment of the gun scraper tool in use.
Figure 26:
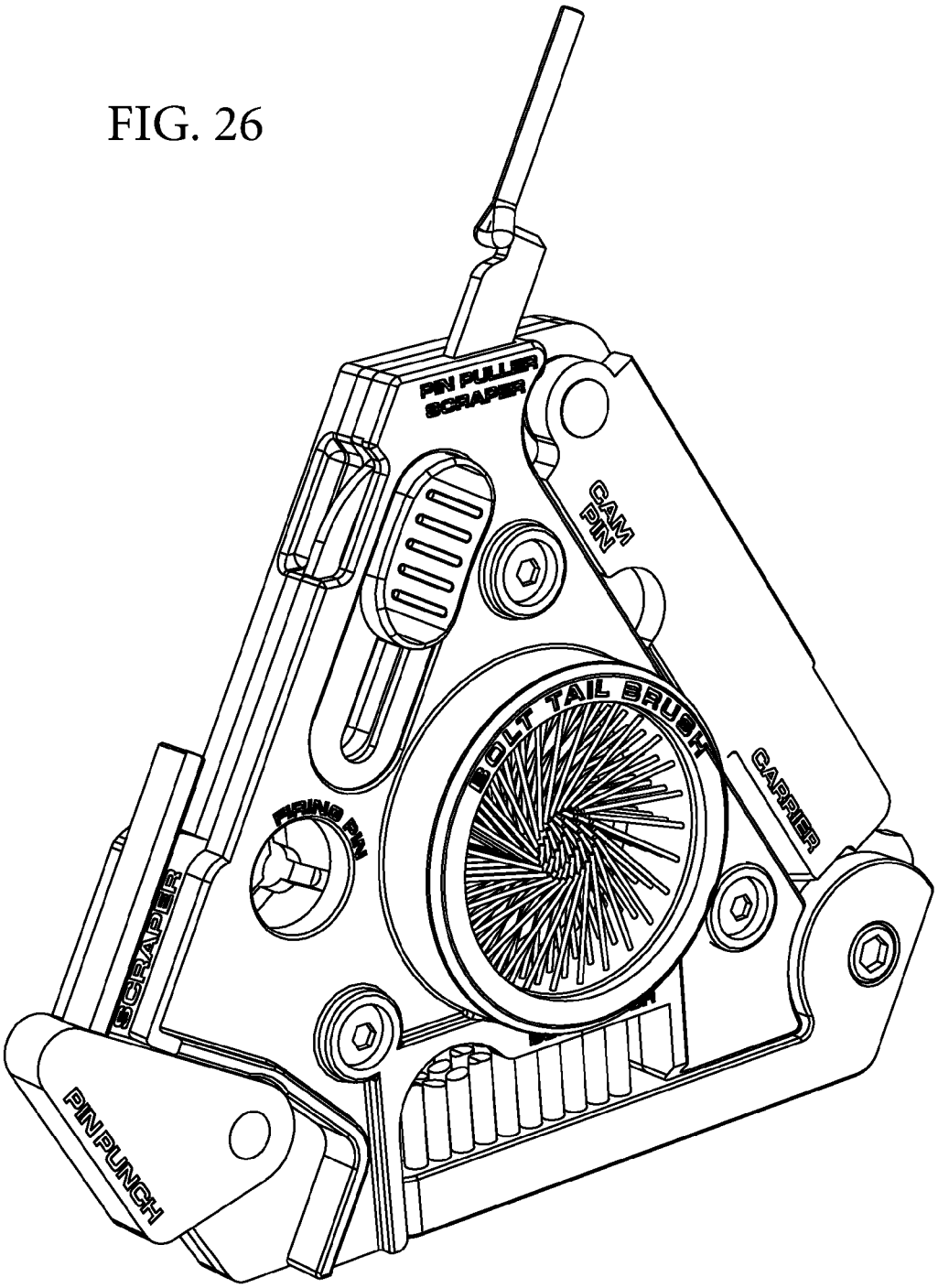
FIG. 26 illustrates one embodiment of the gun scraper tool in use.

Some embodiments of the gun scraper tool can include a pivoting brush 110, illustrated in FIG. 24, which can be useful for removing carbon and residue from multiple surfaces on a bolt, as illustrated in FIG. 25. The pivoting brush 110 can be comprised of two main components: a base and a set of bristles, such as nylon bristles. The base can be made of plastic or metal and can be attached on a first end to one corner of the gun scraper tool and can pivot around that first end to enable the pivoting brush 110 to rotate outward away from the gun scraper tool into an open position, as illustrated in FIG. 24. The bristles can attach on one end to a second end of the base and can be uniform in height. However, as illustrated in FIG. 1, the distal end of the pivoting brush 110 can have a radius cut into the bristles, wherein the radius can be the approximate diameter of the bolt. Therefore, as a user spins the bolt around on the pivoting brush 110, the set of nylon bristles can scrape carbon and residue off of the bolt body.

Additionally, as illustrated in FIGS. 11 and 12, when the pivoting brush 110 is in a closed configuration, the nylon bristles and at least a portion of the base can fit into a cutout in the housing, which can also have an arc-shaped cutout 112 that corresponds to the approximate diameter of the bolt. Therefore, the arc-shaped cutout 112 can be used as a fixture against which a user can brace the bolt when a user is spinning the bolt around and pressing the pivoting brush 110 against it, as illustrated in FIG. 25. Preferably, the radius cut into the bristles aligns with the arc-shaped cutout 112 so that the bolt, when being cleaned, can be confined between the arc-shaped cutout 112 and the radius cut into the bristles.

Figure 27:
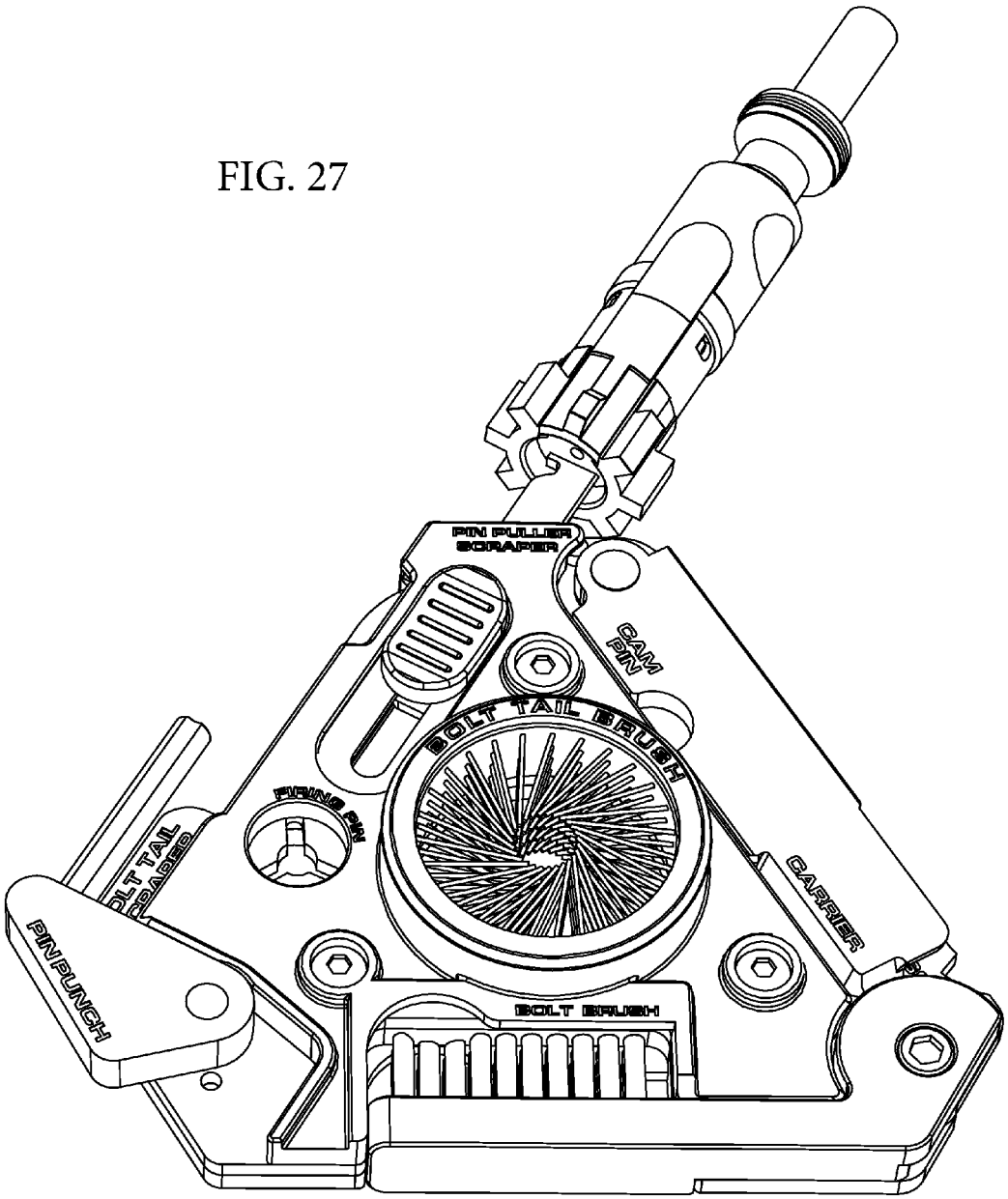
FIG. 27 illustrates one embodiment of the gun scraper tool in use.

As described above, some embodiments include a cotter pin puller 114. The cotter pin puller 114, illustrated in FIG. 27, can be useful for disassembling the bolt carrier group and for scraping a bolt face, as illustrated in FIG. 27. It can be roughly rectangular in shape with a notch near its distal end on a side edge. The notch can allow the distal end of the cotter pin puller 114 to act as a hook. The distal end of the cotter pin puller 114 can also be narrow and can fit within a bolt face, as illustrated in FIG. 27, in order to remove carbon and residue from the bolt face.

To prevent the cotter pin puller 114 from inadvertently catching on items, such as the inside of a pocket, the cotter pin puller 114 can have a contracted configuration and can be attached to a sliding element 128 that is accessible to a user on a top or bottom of the gun scraper tool, as illustrated in FIGS. 1 and 7-10, which enables a user to move the cotter pin puller 114 between its contracted and extended configurations. In the contracted configuration, illustrated in FIG. 11, the cotter pin puller 114 can be enclosed by the housing. To use the cotter pin puller, a user can push the sliding element 128 toward the edge of the housing and the cotter pin puller 114, which can be attached to the sliding element 128, can slide out of the edge of the housing and be exposed in its extended configuration.

Figure 28:
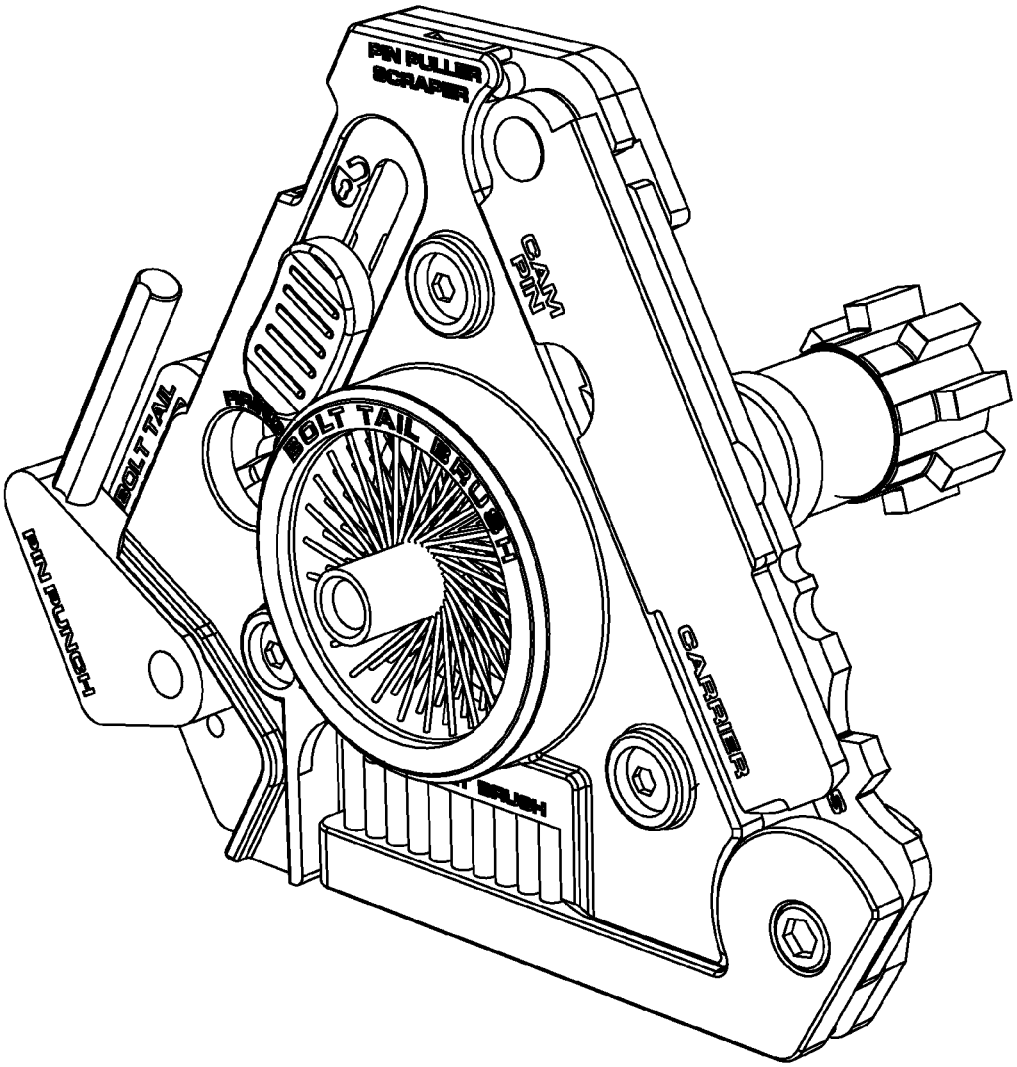
FIG. 28 illustrates one embodiment of the gun scraper tool in use.

Some embodiments of the disclosed gun scraper tool can include a bolt tail brush 116, which can be useful for cleaning the bolt tail after carbon and residue has been scraped off of it, as illustrated in FIG. 28. The outer edge of the bolt tail brush 116, in one embodiment, can be a chamfered edge, as illustrated in FIGS. 1-20. The bolt tail brush 116 can be circular and can have a circular center opening that is slightly narrower than the bolt tail, as illustrated in FIGS. 1-2 and 11-12. Therefore, when a user slides the bolt tail through the center opening, the bolt tail brush 116 can contact all sides of the bolt tail and a user can run the bolt tail back and forth to clean it.

In some embodiments, the bolt tail brush 116 can be made of bronze phosphor bristles, which offer a rigid surface against which the bolt tail can be scraped. However, bronze phosphor bristles are not elastic and can be easily bent and, therefore, may not return back to their original orientation. In other embodiments, the bolt tail brush 116 can be made of nylon bristles, which offer a flexible surface that can be resilient by returning easily to an original orientation. However, nylon bristles are not very stiff and, therefore, may not offer the best possible cleaning surface. In further embodiments, the bolt tail brush 116 can be made of a combination of bronze phosphor bristles and nylon bristles. For example, an inner area of the bristles can be bronze phosphor bristles and an outer, circumferential area can be nylon bristles. In another example, the outer rows can be nylon bristles while the inner row can be bronze phosphor bristles. The bronze phosphor bristles can offer a rigid and better cleaning surface to the user, and the nylon bristles can offer support and resiliency to the bronze phosphor bristles.

As illustrated in FIGS. 1 and 11, the bolt tail brush 116 can be an aperture located in the center of the gun scraper tool housing, and the bristles can attach to flexible support material along the circumference of the bolt tail brush 116. In another embodiment, the bristles can be attached to a separate base component, and the base component can attach to the two outer layers and/or to the middle layer.

Figure 29:
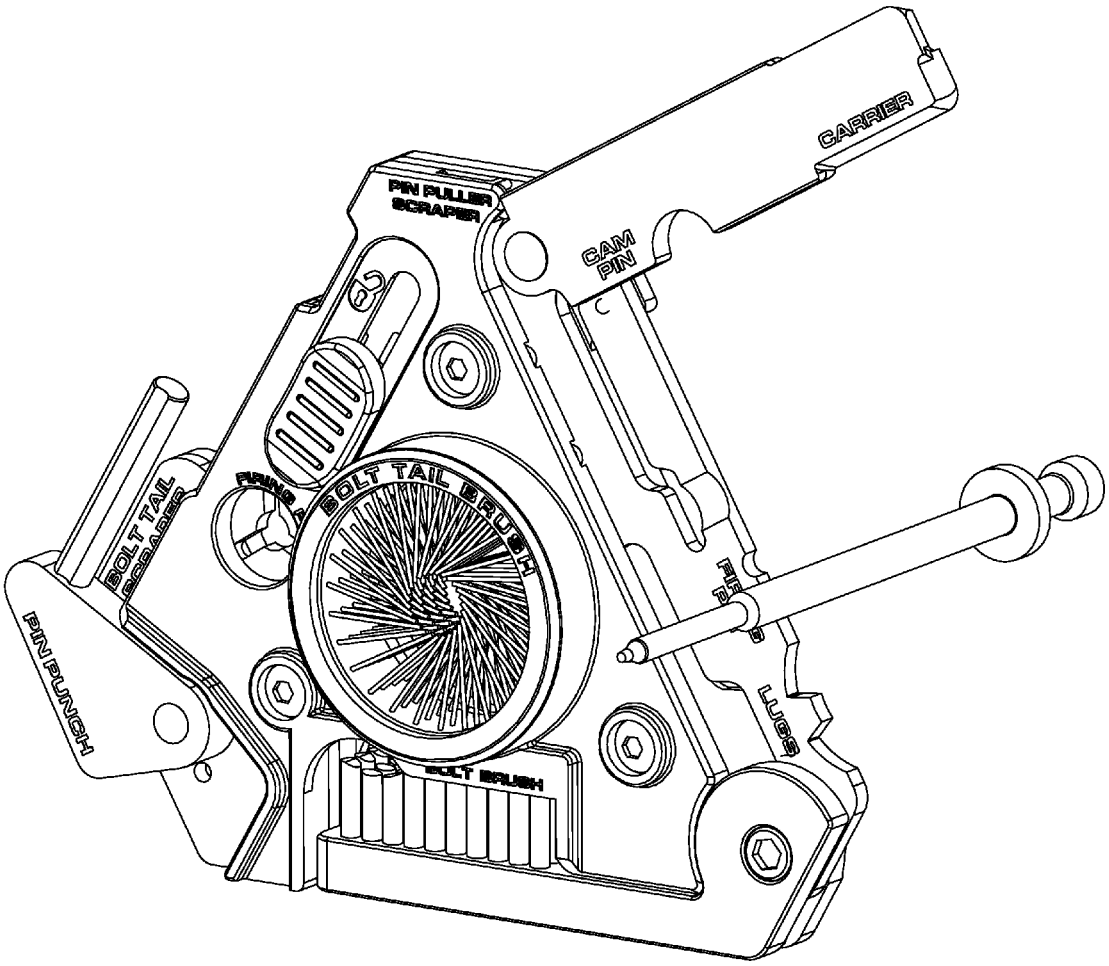
FIG. 29 illustrates one embodiment of the gun scraper tool in use.
Figure 30:
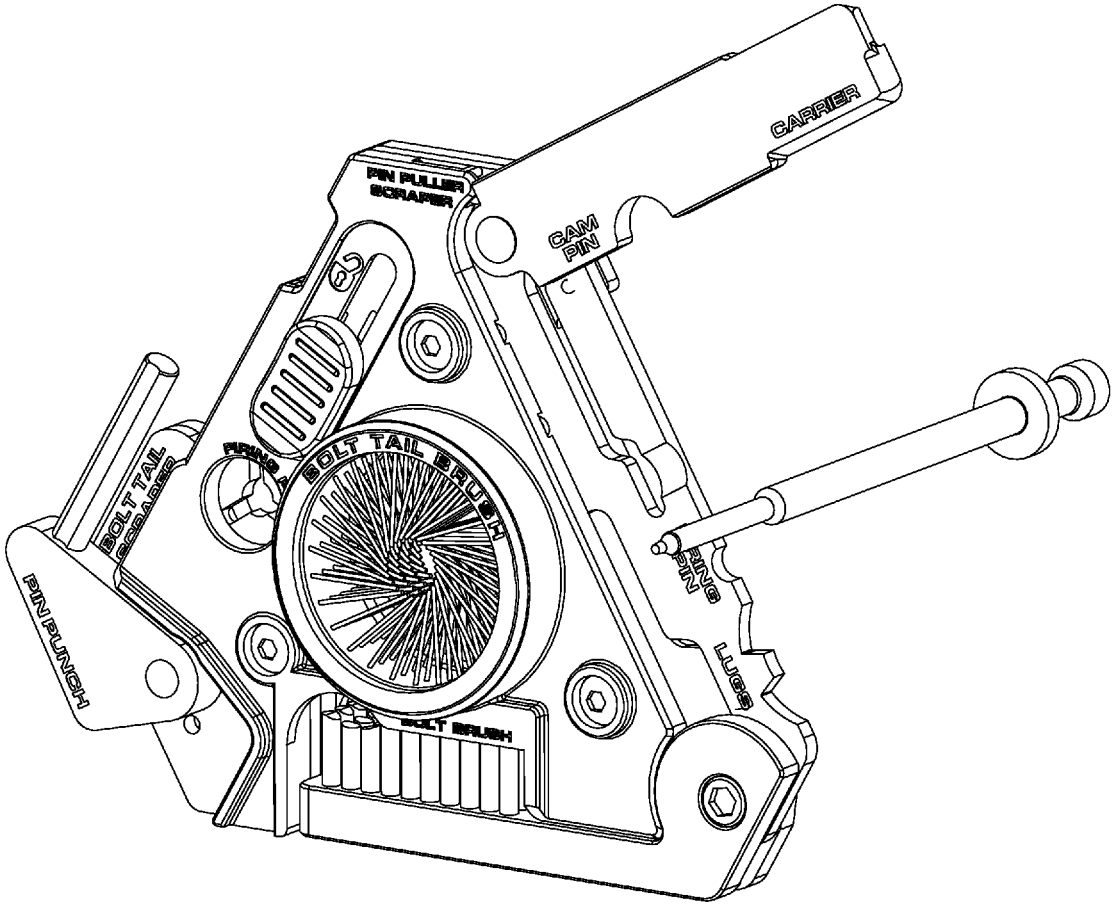
FIG. 30 illustrates one embodiment of the gun scraper tool in use.

As described above, some embodiments include a large firing pin scraper 118 and a small firing pin scraper 120. The large firing pin scraper 118 can be useful for scraping carbon and residue off of the part of a firing pin having a larger diameter, as illustrated in FIG. 29. The small firing pin scraper 120 can be useful for scraping carbon and residue off of the part of a firing pin have a smaller diameter, as illustrated in FIG. 30. For example, a firing pin can be entirely cylindrical but may have a first portion that is larger than a second portion. The second, smaller portion can be small enough to fit into small holes while the first, large portion can offer better stability and prevention from breakage.

As illustrated in FIGS. 1-2, 8, and 12, the large firing pin scraper 118 and the small firing pin scraper 120 can be notched cutouts of the middle layer of the housing, wherein the middle layer can protrude slightly out from the two outer layers of the housing. Alternatively, a metal sheet may extend along one length of the housing and can be attached to the housing, and the notched cutouts can be located along the edge of the metal sheet.

Figure 31:
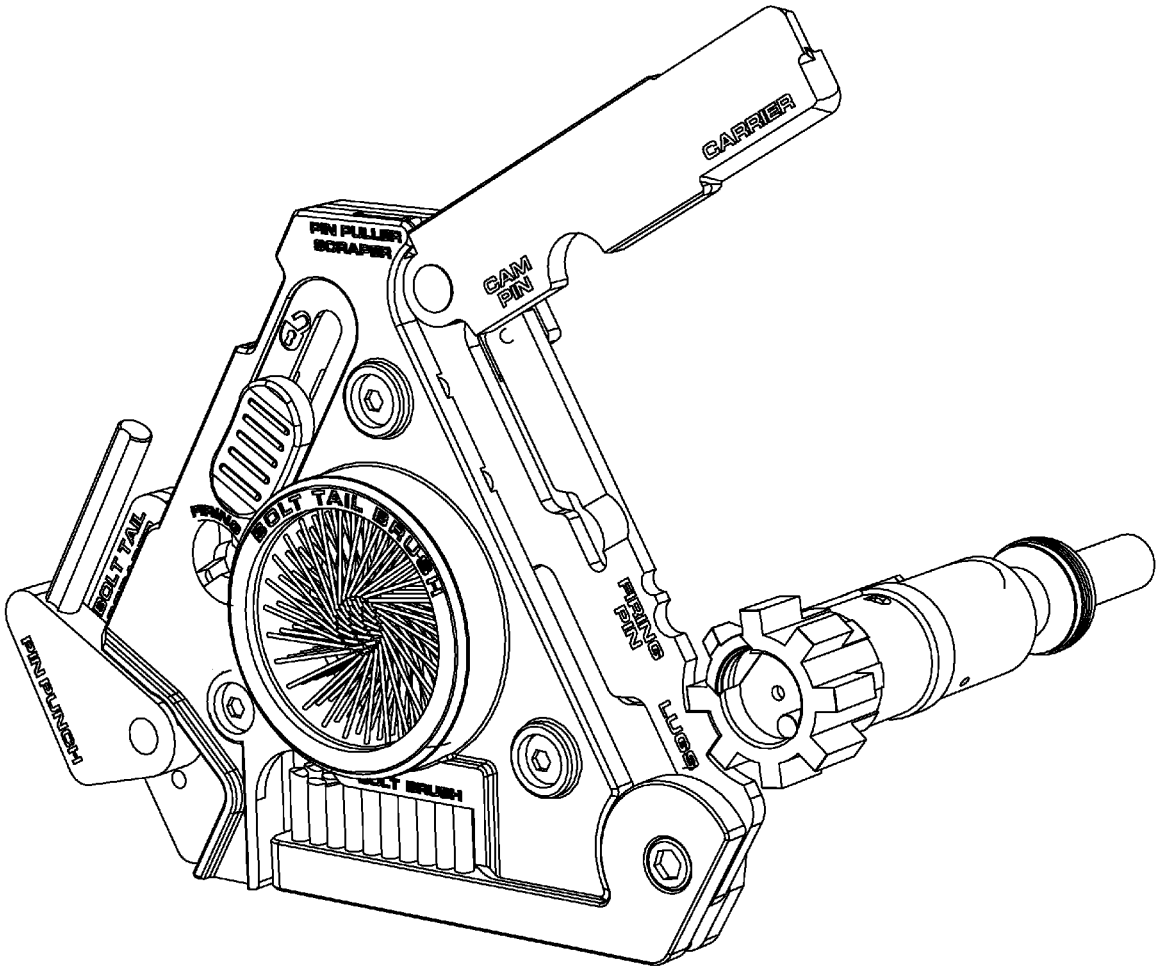
FIG. 31 illustrates one embodiment of the gun scraper tool in use.

Some embodiments of the gun scraper tool can include a bolt lug scraper 122. The bolt lug scraper 122 can be useful for scraping carbon and residue out of the gaps of the bolt lug by using a single, high-toleranced tooth that conforms to the diameter and angle of the teeth of the bolt lug, as illustrated in FIG. 31. For example, a user can put the bolt lug scraper 122 between two teeth of the bolt lug and then move the bolt lug back and forth to scrape the carbon and residue off.

As illustrated in FIGS. 1-2, 8, and 12, the bolt lug scraper 122 can have a central, protruding tooth centered on an arc-shaped cutout, wherein the cutout can be a cutout of the middle layer of the housing or, alternatively, a cutout of a metal sheet that extends along one length of the housing and is attached to the housing. Additionally, the bolt lug scraper 122 can be located next to the large firing pin scraper 118 and the small firing pin scraper 120.

Figure 32:
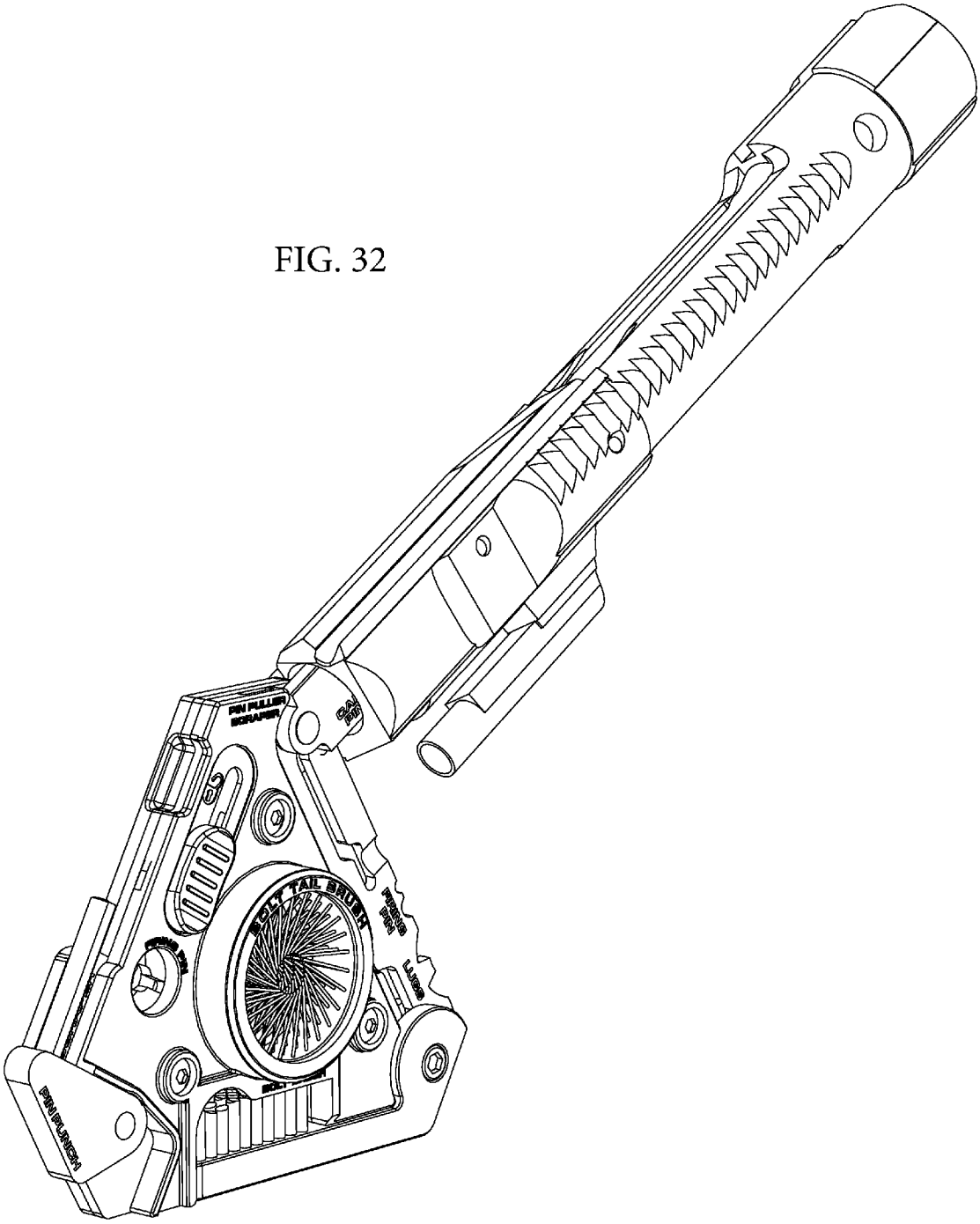
FIG. 32 illustrates one embodiment of the gun scraper tool in use.

In some embodiments, the gun scraper tool can include a bolt carrier scraper 124, which can be useful for scraping the interior diameter and interior base of the carrier, as illustrated in FIG. 32. For example, the bolt carrier scraper 124 can be roughly rectangular in shape and may have a width that corresponds to the diameter of the carrier. As a user twists the bolt carrier scraper 124 around, the edges scrape the carbon and residue off of the interior base of the carrier.

As illustrated in FIGS. 1-2 and 7-10, the bolt carrier scraper 124 can be pivotally attached to the gun scraper tool on a first, proximal end, and the second, distal end can be free to rotate. Therefore, a user can pull on the second, distal end to pivot the bolt carrier scraper 124 away from the housing of the gun scraper tool into an extended position and can then insert the second, distal end into a carrier to scrape away carbon and residue from the interior of the carrier.

When in the contracted position, the bolt carrier scraper 124 can align next to the large firing pin scraper 118, the small firing pin scraper 120, and the bolt lug scraper 122, as illustrated in FIG. 20.

Figure 33:
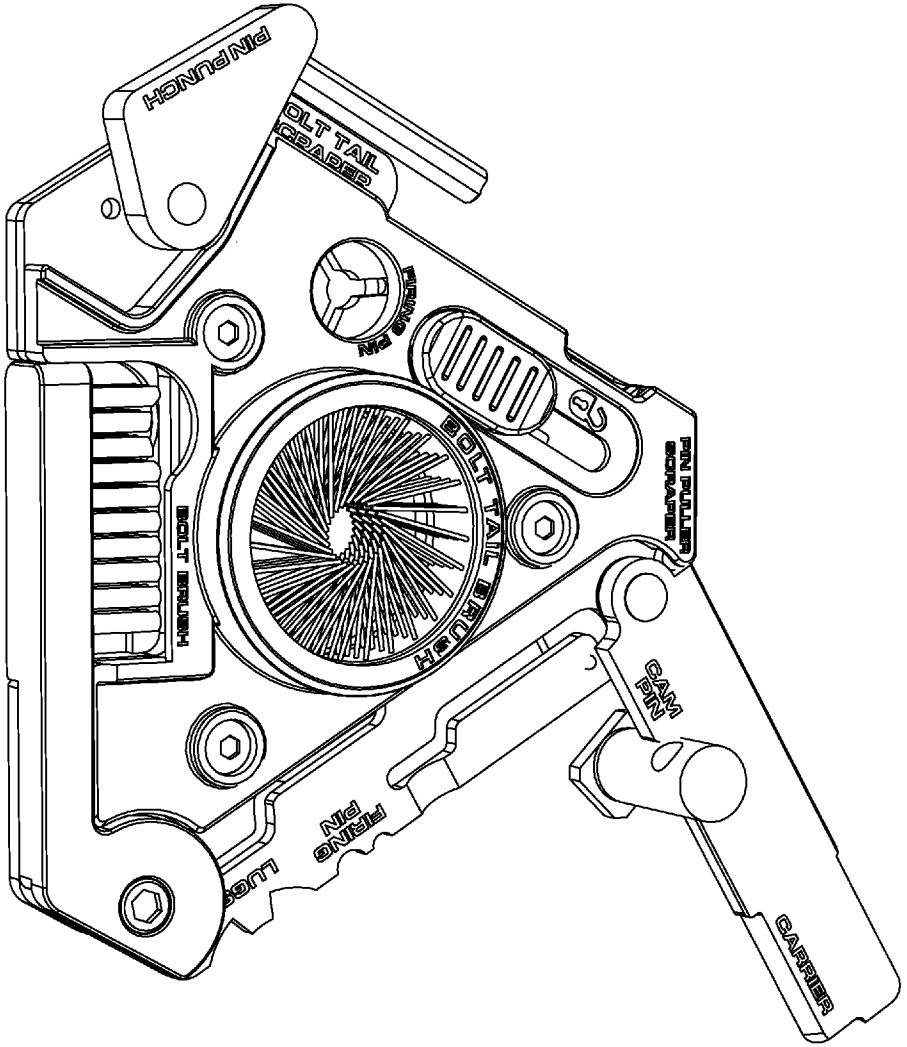
FIG. 33 illustrates one embodiment of the gun scraper tool in use.

In some embodiments, and as illustrated in FIGS. 1-2, 7-11, and 17-20, the bolt carrier scraper 124 can have a semi-circular cutout along one edge that operates as a bolt cam pin scraper 126. The bolt cam pin scraper 126 can be useful for scraping the exterior surface of the bolt cam pin, as illustrated in FIG. 33. In one embodiment, the bolt cam pin scraper 124 can be located on the edge of the bolt carrier scraper 124 that faces the center of the housing when in the contracted position, thereby protecting the bolt cam pin scraper 124 from contact with other objects.

While the various embodiments described herein disclose several features, reference to those features does not limit the scope of the gun scraper tool. The examples set forth in this specification are not intended to be limiting and merely set forth some of the many possible embodiments of the gun scraper tool.

What is claimed is:

1. A gun scraper tool for scraping carbon and residue off of a firearm, the gun scraper tool comprising:

a triangular housing having three sides, an upper face, and a bottom face, and comprising:

a first outer housing layer;

a second outer housing layer; and a middle housing layer sandwiched between the first and second outer housing layers;

an aperture in the center of the housing passing through the first outer housing layer, the second outer housing layer, and the middle housing layer; a brush in the aperture having bristles extending from the perimeter of the aperture to a central opening; and a plurality of tool components structured and configured to use the housing as a base wherein the first and second outer housing layers and the middle housing layer align on top of one another.

2. The gun scraper tool of claim 1, wherein the first and second outer housing layers are made of plastic and the middle housing layer is made of metal.

3. The gun scraper tool of claim 2, wherein the plurality of tool components is comprised of:

a spindle;

an exterior scraping blade;

a pivoting brush having a base and a set of bristles;

a cotter pin puller;

a bolt tail brush having bristles; and a bolt carrier scraper.

4. The gun scraper tool of claim 1, wherein the brush comprises a bolt tail brush.

5. A handheld gun scraper tool for scraping carbon and residue off of a firearm, the gun scraper tool comprising:

a triangular housing having three sides and being comprised of a plurality of layers aligned on top of one another, wherein the layers comprise:

a first outer housing layer;

a second outer housing layer; and a middle housing layer sandwiched between the first and second outer housing layers;

an aperture in the center of the housing passing through the first outer housing layer, the second outer housing layer, and the middle housing layer; a brush in the aperture having bristles extending from the perimeter of the aperture to a central opening;

at least one moveable tool component configured to attach to the housing; and at least one stationary tool component configured as a component of the housing wherein the at least one moveable tool component is configured to move between a closed and an open configuration, and wherein the at least one stationary tool component is fixed in place in the housing.

6. The gun scraper tool of claim 5, wherein the plurality of layers is comprised of:

a top layer made from a first rigid material;

a middle layer made from a second rigid material; and a bottom layer made from the first rigid material, wherein the middle layer is sandwiched between, and is the same shape and size as the top layer and the bottom layer.

7. The gun scraper tool of claim 5, wherein the at least one moveable tool component is configured to pivot from the contracted position out and away from the housing to the extended position.

8. The gun scraper tool of claim 5, wherein the at least one moveable tool component is configured to slide between the contracted position and the extended position.

9. The gun scraper tool of claim 5, wherein the at least one stationary tool component is a scraping tool formed from a cutout of the middle layer.

10. The gun scraper tool of claim 5, wherein the at least one stationary tool component includes a brush.

11. A gun scraper tool for scraping carbon and residue off of a firearm, the gun scraper tool comprising:

a triangular housing having three sides, an upper face, and a bottom face, the housing comprising:

a first outer housing layer;

a second outer housing layer; and a middle housing layer sandwiched between the first and second outer housing layers; and a plurality of tool components structured and configured to use the housing as a base, wherein the first and second outer housing layers and the middle housing layer align on top of one another, wherein a spindle and exterior scraping blade are configured to align with each other to simultaneously contact an interior and exterior portion of a bolt tail, wherein a base of a pivoting brush is pivotally attached to the housing, enabling the pivoting brush to rotate outward away from the housing, wherein a set of bristles of the pivoting brush has a radius cut into a least a portion of the set of bristles, wherein a cotter pin puller that is rectangular in shape, has a notch near a distal end of the cotter pin puller and on a side edge, wherein a bolt tail brush having bristles is in an aperture in a center portion of the housing; and wherein a bolt carrier scraper that is rectangular in shape is pivotally attached to the housing, enabling the bolt carrier scraper to rotate outward away from the housing.

12. The gun scraper tool of claim 11, wherein the plurality of tool components is further comprised of:

a spindle mount pivotally attached to the housing on a first end and fixedly attached to the spindle on a second end;

an internal firing pin scraper that is rooted in, and surrounded by the housing;

an arc-shaped cutout that aligns with the set of bristles of the bolt tail brush;

an external firing pin scraper comprised of a notched cutout of the middle housing layer, wherein a portion of the middle housing layer having the notched cutout protrudes slightly out from one of the three sides of the first and second outer housing layers;

a bolt lug scraper having a central, protruding tooth centered on an arc-shaped cutout of the middle housing layer, wherein a portion of the middle housing layer having the bolt lug scraper protrudes slightly out from the first and second outer housing layers;

a bolt cam pin scraper comprised of a semi-circular cutout along one edge of the bolt carrier scraper; and a sliding element attached to the cotter pin puller and configured to enable a user to move the cotter pin puller between a contracted and an extended configuration.

* * * * *